United States Patent [19]

Hoyle et al.

[11] 4,322,211

[45] Mar. 30, 1982

[54] DEVELOPMENT OF COLOR IN WOOD WITH AMINOBENZENESULFONYL AZIDES

[75] Inventors: Charles E. Hoyle; Ronald S. Lenox, both of Lancaster, Pa.

[73] Assignee: Armstrong World Industries, Inc., Lancaster, Pa.

[21] Appl. No.: 265,602

[22] Filed: May 20, 1981

[51] Int. Cl.[3] ..... B27K 5/02

[52] U.S. Cl. ..... 8/402

[58] Field of Search ..... 8/402

[56] References Cited

U.S. PATENT DOCUMENTS 2,772,137 11/1956 Weber ..... 8/402

2,964,562 12/1960 Landau ..... 8/402

*Primary Examiner*—Maria Parrish Tungol

*Attorney, Agent, or Firm*—Daniel De Joseph

[57] ABSTRACT

The present invention discloses a method of photolytically developing a walnut wood color on a wood sample. The sample is contacted with a salt of an aminobenzenesulfonyl azide. The sample is thereafter exposed to a light source for an amount of time sufficient to produce a walnut wood color thereon.

8 Claims, No Drawings

DEVELOPMENT OF COLOR IN WOOD WITH AMINOBENZENESULFONYL AZIDES

DESCRIPTION OF THE INVENTION

The invention contemplates a method of photolytically developing a walnut wood color on a wood article. The method of the invention comprises first pretreating the wood by contacting its surface with a solution of water and a salt of an aminobenzenesulfonyl azide of the Formula

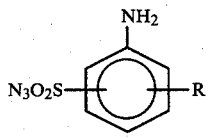

wherein, in the formula, R is H, a $C_1$–$C_4$ alkoxy group or a $C_1$–$C_4$ alkyl group. After this pretreatment step, the wood is then exposed to a light source, whereupon an attractive and realistic walnut wood color photolytically develops on the wood.

The term $C_1$–$C_4$ alkyl is used herein to indicate an unsaturated straight or branched chain alkyl group having from 1 to 4 carbon atoms. The term $C_1$–$C_4$ alkoxy is used herein to indicate an unsubstituted straight or branched chain alkoxy group having from 1 to 4 carbon atoms.

Any light, unpainted or otherwise uncolored or nontreated wood may be utilized in the present invention. Suitable woods include oak, maple, pine, pecan and bast.

The wood sample may be contacted with the aqueous aminobenzenesulfonyl azide salt solution in any manner that is convenient to the individual practitioner of the invention. For example, the sample may be completely or partially immersed in the solution or the solution may be sprayed or brushed on the sample. The solution may be applied to all or a portion of the sample, in the latter case the solution may be applied so as to produce a decorative pattern on the sample. For example, the wood may be patterned by placing a decorative mask over the wood, treating the exposed portions of the wood with the solution, removing the mask and exposing the wood sample to light.

After being contacted with the solution, the wood sample may optionally be water washed and, if desired, dried. The sample is then exposed to a light source for an amount of time sufficient to develop a walnut wood color on the sample.

The aqueous salt solution should be maintained at an acidic pH, i.e. no more than 7. Lower pH's, i.e. below about 2, are preferred since the aminobenzenesulfonyl azide salt dissolves more readily in water at such lower pH's. Most preferably, the pH of the solution will be below 1. Basic pH's are not suitable for the solution, as sulfonyl azides will rapidly decompose in a basic solution. Any mineral acid may be utilized to maintain the solution at an acidic pH. The term "mineral acid" is used herein to describe acids which do not dissociate to form an organic residue. Examples of suitable acids include hydrochloric acid, nitric acid, sulfuric acid, phosphoric acid and phosphorous acid.

The temperature of the solution is not an important parameter of this invention. Indeed, any temperature at which the solution remains in a liquid state is suitable for the purposes of this invention. With all other factors being identical, it has been discovered that higher solution temperatures will produce darker cherry wood and walnut wood colors on the wood samples than lower solution temperature.

The solution will contain from about 0.001 to about 10 g of the azide salt per 100 ml of water. At lower concentrations, the wood samples will have to be treated for longer periods of time in order to obtain a noticeable color change. Theoretically, concentrations of azide salt lower than 0.001 g/100 ml water may be utilized to achieve a coloration effect. However, at such low concentrations, the wood samples would have to be treated for such long periods of time that the wood itself might be harmed by water swelling.

The upper concentration of salt is only limited to the amount of salt that can be put into solution. Normally, more salt can be put into solution as the temperature of the solution increases or if the solution is put under pressure, such as if the individual practitioner of this invention desires to pressure treat the wood. With all other factors being identical, it has been discovered that higher salt concentrations in the solution will produce darker walnut wood colors on the wood samples than lower salt concentrations.

The amount of light exposure time needed to develop a walnut wood color on a wood sample is dependent on parameters such as the intensity of the light source, the concentration of the salt in the solution, the temperature of the solution and/or the amount of time the sample was contacted with the solution. One can, by increasing any of these parameters, lessen the amount of light exposure time needed to develop a walnut wood color on a wood sample.

Any light source is suitable for photolytically developing a walnut wood color on the treated sample, although light sources with both visible and ultraviolet output are preferred. Examples of suitable light sources include sunlamps and mercury lamps. The treated sample will also develop a walnut wood color in the presence of sunlight alone, although the exposure time needed to develop such a color is considerably longer in sunlight than with any of the other light sources specifically set forth above.

It is understood that the practitioner of this invention can vary the shade of the walnut wood coloration by varying selected factors such as the concentration of the salt in the solution the treatment contact time and the temperature of the solution. Alternatively, when the desired shade of walnut wood is realized on the treated wood sample, the sample may then be covered with an effective light screening agent to thereby prevent the sample from developing a darker walnut wood color.

It has also been discovered that wood samples, when treated according to the process of this invention, display an enhanced directional flip effect.

Directional flip is a term for the change, with reference to the viewer, the visual qualities of many finished wood products with the angle of incident light on the surface of the wood. This effect is manifested by the transformation of the area viewed on the wood from light to dark shades and vice versa as the angle of incident illumination and/or the angle of view are changed.

This invention also contemplates developing a cherry wood color on a wood sample by contacting the sample with an aqueous solution containing a hydrochloride salt of an aminobenzenesulfonyl azide. The cherry wood color which develops on the wood will vary from a pale cherry wood color to a dark cherry wood color depending on factors such as the type of wood used, the concentration of the salt in the solution, the temperature of the solution, and the length of contact time. If the wood sample is not exposed to a light source it will maintain its cherry wood color. The cherry wood color can also be maintained by thereafter coating the wood sample with an effective ultraviolet light screening agent in a clear protective coat. Examples of suitable light screening agents are those sold by the Geigy Chemical Co. under the name Tinuvin, which is a trademark for a family of substituted hydroxyphenyl benzotriazoles, such as 2-(2'hydroxy-5'-methylphenyl) benzotriazole.

Aminobenzenesulfonyl azides according to the Formula above may be reacted with any mineral acid to form a salt that will be suitable for use in the method of the present invention. Examples of suitable mineral acids include HBr, $H_2SO_4$ and $H_3PO_4$. HCl is the mineral salt of choice because it provides for very easy synthesis of the stable salt.

For example, hydrochloric salts which are suitable for use in the method of the present invention are prepared by treating methylene chloride solutions of the free aminobenzenesulfonyl azides with gaseous HCl. The synthesis of the aminobenzenesulfonyl azides is known (see T. Curtis, W. Stoll, *J. Prakt Chem,* 112, 1117 (1926) and British Intelligence Objective Sub-Committee, Final Report 1149, p. 24) and is quite straightforward, i.e., via the chlorosulfonation of the corresponding acetylated amines followed by condensation of the resulting sulfonyl chloride with sodium azide.

EXAMPLE 1

Preparation of 4-aminobenzenesulfonyl azide hydrochloride:

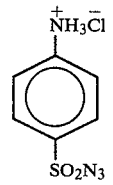

(Compound I)

Ten grams of 4-aminobenzenesulfonyl azide was dissolved in 0.4 liters of dry methylene chloride and gaseous HCl was bubbled through the solution for 10 minutes. The insoluble salt which formed was collected by suction filtration and placed under vacuum for several hours to remove excess HCl. The product compound was formed quantitatively (11.8 g) as a white solid, which decomposed at 175°–178° C. with the evolution of gas. NMR spectra, obtained on a JEOL-H-100 Spectrometer, and IR spectra, determined on a Perkin Elmer 457 instrument, revealed the following values which are consistant with the assigned structure:

NMR (DMSO-$d_6$): 6.94 (d,2H), 7.71 (d,2H), 8.79 (s,3H, —$NH_3$).

IR (KBr): 2280 (s), 2130 (s), 1591 (m), 1489 (s), 1365 (s), 1160 (s), 1084 (s), 819 (s), 748 $cm^{-1}$ (s).

EXAMPLE 2

Preparation of 1-amino-2-methoxy-5-benzenesulfonyl azide hydrochloride:

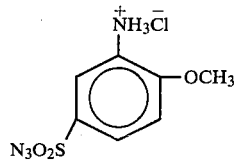

(Compound II)

Ten grams of 3-amino-4-methoxybenzenesulfonyl azide was dissolved in 0.4 liters of dry $CH_2Cl_2$. Dry HCl gas was bubbled through the solution for 10 minutes. The resulting solid was collected and was stored under vacuum for several hours to remove excess HCl. 11.6 g of the product compound was recovered as a white solid, mp. from 184°–186° C. was observed with the evolution of gas. NMR and IR spectra revealed the following values which are consistent with the assigned structures:

NMR (DMSO-$d_6$): 3.98 (s,3H), 7.30–7.98 (m,3H), 9.47 (s,3H, —$N\underline{H}_3$).

IR (KBr): 2850 (s), 2580 (s), 2058 (s), 1621 (m), 1500 (s), 1378 (s), 1279 (s), 758 (s), 608 $cm^{-1}$ (s).

EXAMPLES 3—32

The following solutions were utilized in these Examples:

Solution A:
- 1 g compound I
- 5 ml concentrated HCl
- 100 ml water
- Solution pH<0

Solution B:
- 1 g compound II
- 5 ml concentrated HCl
- 100 ml water
- Solution pH<0

Solution C:
- 0.1 g compounds I
- 0.4 ml concentrated HCl
- 100 ml water
- Solution pH 1.3

Solutions A and B were maintained at 100° C. and Solution C was maintained at 25° C.

Blocks of oak and maple wood, each 1"×1"×1" were treated by being completely immersed in either of the above solutions for from 1 to 3 minutes. The blocks of wood were then removed from the solution baths, water rinsed and dried at room temperature. The treated wood blocks displayed a cherry wood color. Some of the blocks were then exposed to a General Electric sunlamp for 5 minutes, which resulted in the development of a darker walnut wood color.

Table 1 sets forth the particular treatment conditions and results for each Example.

TABLE I

| Ex. No. | Wood Type | Sol. | Treatment Time | Wood Color After Treatment | Sunlamp Exposure | Sunlamp Induced Wood Color |
|---|---|---|---|---|---|---|
| 3 | Oak | A | 1 min. | Cherry | Yes | Walnut |
| 4 | Oak | A | 1 min. | Cherry | No | — |
| 5 | Oak | A | 2 min. | Cherry | Yes | Walnut |
| 6 | Oak | A | 2 min. | Cherry | No | — |
| 7 | Oak | A | 3 min. | Cherry | Yes | Walnut |
| 8 | Oak | A | 3 min. | Cherry | No | — |
| 9 | Oak | B | 1 min. | Cherry | Yes | Walnut |
| 10 | Oak | B | 1 min. | Cherry | No | — |
| 11 | Oak | B | 2 min. | Cherry | Yes | Walnut |

TABLE I-continued

| Ex. No. | Wood Type | Sol. | Treatment Time | Wood Color After Treatment | Sunlamp Exposure | Sunlamp Induced Wood Color |
|---|---|---|---|---|---|---|
| 12 | Oak | B | 2 min. | Cherry | No | — |
| 13 | Oak | B | 3 min. | Cherry | Yes | Walnut |
| 14 | Oak | B | 3 min. | Cherry | No | — |
| 15 | Maple | A | 1 min. | Cherry | Yes | Walnut |
| 16 | Maple | A | 1 min. | Cherry | No | — |
| 17 | Maple | A | 2 min. | Cherry | Yes | Walnut |
| 18 | Maple | A | 2 min. | Cherry | No | — |
| 19 | Maple | A | 3 min. | Cherry | Yes | Walnut |
| 20 | Maple | A | 3 min. | Cherry | No | — |
| 21 | Maple | B | 1 min. | Pale Cherry | Yes | Pale Pink |
| 22 | Maple | B | 1 min. | Pale Cherry | No | — |
| 23 | Maple | B | 2 min. | Light Cherry | Yes | Grey Walnut |
| 24 | Maple | B | 2 min. | Light Cherry | No | — |
| 25 | Maple | B | 3 min. | Light Cherry | Yes | Light Cherry |
| 26 | Maple | B | 3 min. | Light Cherry | No | — |
| 27 | Oak | A | 1 sec. | Cherry | Yes | Walnut |
| 28 | Oak | A | 1 sec. | Cherry | No | — |
| 29 | Oak | A | 10 min. | Cherry | yes | Walnut |
| 30 | Oak | A | 10 min. | Cherry | No | — |
| 31 | Oak | C | 10 sec. | Cherry | Yes | Walnut |
| 32 | Oak | C | 10 sec. | Cherry | No | — |

What is claimed is:

1. A method of photolytically developing walnut wood color on a wood sample, which comprises treating the sample by contacting the surface area thereof with an acidic solution comprising water and a salt of an aminobenzenesulfonyl azide of the formula

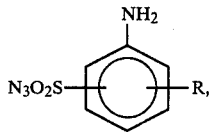

wherein R is H, a $C_1$–$C_4$ alkoxy group or a $C_1$–$C_4$ alkyl group, and exposing the treated sample to a light source to thereby develop a walnut color on the sample.

2. The method of claim 1 wherein the solution contains from 0.001 to 10 grams of the salt per 100 ml of water.

3. The method of claim 1 wherein the salt is a hydrochloride salt.

4. The method of claim 3 wherein R represents H.

5. The method of claim 3 wherein R represents $OCH_3$.

6. The method of claim 1 wherein the pH of the solution is less than about 2.

7. The method of claim 1 which further comprises coating the wood article with a clear light screening agent after a desired walnut wood coloration is developed on the article.

8. The method of claim 1 wherein only a portion of the surface area of the sample is contacted with the acidic solution.

* * * * *